US006591900B1

(12) United States Patent
Kato et al.

(10) Patent No.: US 6,591,900 B1
(45) Date of Patent: Jul. 15, 2003

(54) HEAT EXCHANGER, TUBE FOR HEAT EXCHANGER, AND METHOD OF MANUFACTURING THE HEAT EXCHANGER AND THE TUBE

(75) Inventors: Soichi Kato, Saitama (JP); Shoji Akiyama, Saitama (JP); Kazuo Ochiai, Saitama (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 0 days.

(21) Appl. No.: 10/070,539

(22) PCT Filed: Aug. 29, 2000

(86) PCT No.: PCT/JP00/05831

§ 371 (c)(1),
(2), (4) Date: Jun. 10, 2002

(87) PCT Pub. No.: WO01/18472

PCT Pub. Date: Mar. 15, 2002

(30) Foreign Application Priority Data

Sep. 8, 1999 (JP) ..... 11-254232
Oct. 8, 1999 (JP) ..... 11-287535

(51) Int. Cl.[7] ..... F28F 1/00

(52) U.S. Cl. ..... 165/177; 165/183; 29/890.053; 138/115; 138/170

(58) Field of Search ..... 165/177, 176, 165/178, 183; 29/890.052, 890.053, 890.054; 138/115, 170, 171, 16.3

(56) References Cited

U.S. PATENT DOCUMENTS 5,186,251 A * 2/1993 Joshi ..... 165/177
5,765,634 A * 6/1998 Martins ..... 165/177
5,875,668 A * 3/1999 Kobayashi et al. ..... 138/115
5,890,288 A * 4/1999 Rhodes et al. ..... 29/890.053
5,956,846 A * 9/1999 Ross et al. ..... 29/890.054
6,129,147 A * 10/2000 Dumetz et al. ..... 165/177

* cited by examiner

*Primary Examiner*—Henry Bennett
*Assistant Examiner*—Temell McKinnon
(74) *Attorney, Agent, or Firm*—Kanesaka & Takeuchi

(57) ABSTRACT

A heat exchanger (1) is formed by stacking tubes (2) formed by rolling a flat tube material (10) with a fin (3) interposed between the adjacent tubes, joining tanks (4), (5) and the tubes, (2) to appropriately communicate the tubes (2) and the tanks (4), (5), wherein the tube (2) is provided with a partition (22) for dividing a passage (6) of the tube (2) into passages (6),(6) and the partition (22) has an extra section for absorbing a deformation produced when a partition part (30) and the tube are formed.

4 Claims, 17 Drawing Sheets

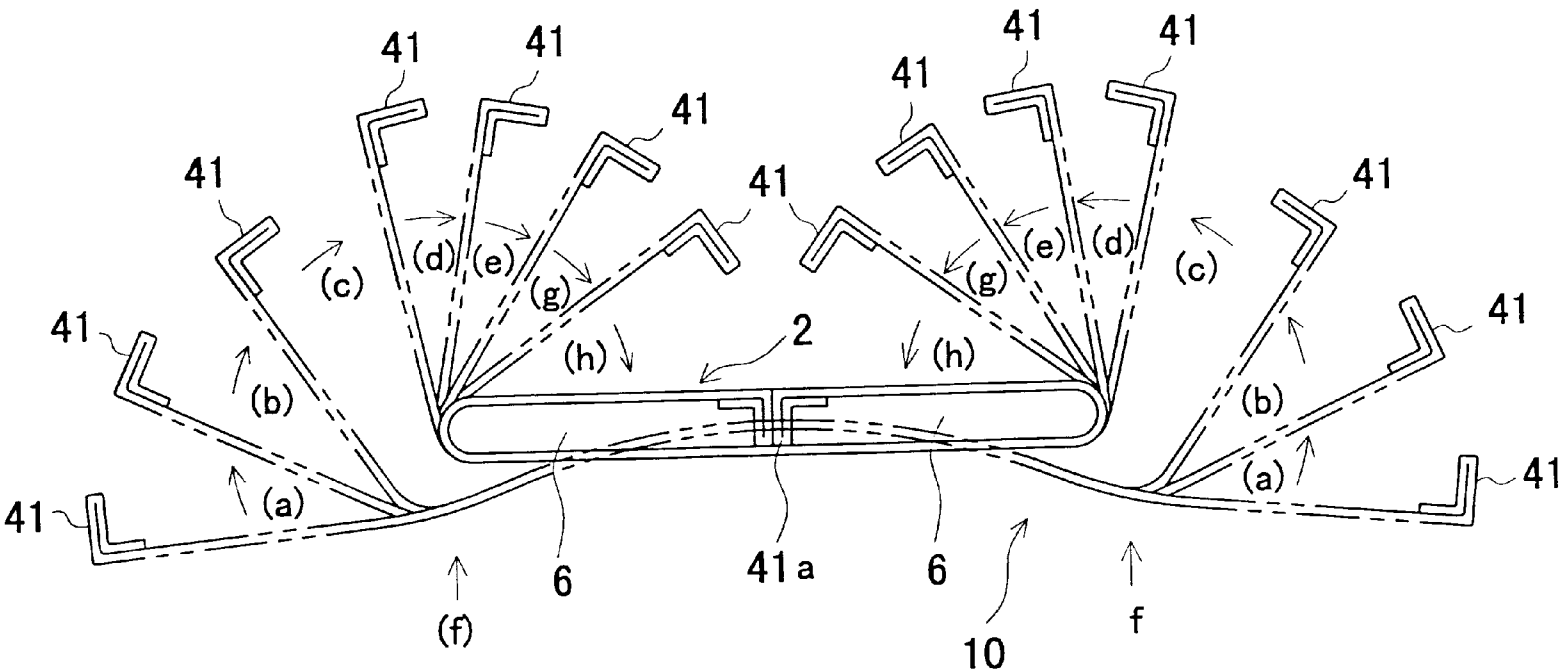
41
41
41

HEAT EXCHANGER, TUBE FOR HEAT EXCHANGER, AND METHOD OF MANUFACTURING THE HEAT EXCHANGER AND THE TUBE

1. Technical Field

The present invention relates to a tube for a heat exchanger formed by rolling an aluminum material to provide a partition for dividing a passage, its production method and a heat exchanger using the tube.

2. Background Art

Conventionally, as a tube for a heat exchanger, there is known a flat tube which is formed by rolling an aluminum material.

For example, a heat exchanger used for vehicles may be a combination of at least two heat exchangers having different functions.

Among the tubes used for such heat exchangers, the tube described in, for example, Japanese Patent Laid-Open Publication No. 6-123571 or No. 7-41331, is formed by having a partition which is formed to have an approximately θ-shape cross section by bending an aluminum material in multiple stages by rolling, and forming a plurality of passages in the tube by adhering the partition and a wall facing the partition by brazing in an oven.

This type of tube for a heat exchanger is formed with the partitions in the tube even though the number of step is relatively few, so that recently it is used as a tube for a heat exchanger used for a refrigeration cycle for cars.

The heat exchangers are becoming smaller in size with improvement of their performance. Therefore, an aluminum improvement of their performance. Therefore, an aluminum material having a less thickness of about 0.2 mm is being used for the tubes for the heat exchangers. The size of tube being used is made very small and thin with dimensions of a width of about 15 mm and a height of about 1.5 mm.

A heat exchanger tube to be used for a compact heat exchanger is required to have an accuracy for the dimensional control when it is formed by rolling. Meanwhile, the formed tube has dimensional unevenness concentrated on the neighborhood of the portion corresponding to the ends of the tube material in the final sectional shape.

For example, when the tube is formed, a partition part is formed at ends of the tube material and the partition parts formed at both ends of the material are joined to form a partition. When the partition parts are formed at the ends of the tube material where unevenness tends to occur while the tube is being formed, a gap or the like is formed on the tube, and the dimensional control may become insufficient. And, brazing may become defective depending on a degree of unevenness produced. The tube for a heat exchanger which has a defective brazing or the like has a defective pressure strength, or the right and left passages in the tube become non-uniform. Therefore, there is a problem that a defective bypass is produced or leakage to outside occurs.

Therefore, it is an object of the present invention to provide a tube for a heat exchanger which is produced while eliminating unevenness which could be caused in machining to form the tube, its production method and a heat exchanger.

SUMMARY OF THE INVENTION

The invention described in claim 1 is a heat exchanger formed by rolling a flat tube material, forming tubes having a passage with at least one end open, stacking the tubes with fins interposed between adjacent tubes, disposing tanks on the side of the passage openings of the tubes, joining the tanks and the tubes to appropriately communicate the tubes and the tanks, wherein the tubes are provided with a first flat section, first erected sections which are erected at about right angles from both ends of the first flat section, and a second flat section which is continuous from the first erected sections and substantially parallel to the first flat section; partition parts are formed on the second flat section by bending the ends of the second flat section; and the partition parts are contacted with the first flat section to establish a partition for dividing the passage of the tubes.

The invention described in claim 2 is a tube for a heat exchanger which is formed by rolling a flat tube material and has a passage with at least one end open, wherein the tube is provided with a first flat section, first erected sections which are erected at about right angles from both ends of the first flat section, a second flat section which is continuous from the first erected sections and substantially parallel to the first flat section, and a partition for dividing a tube passage; and the partition is provided with partition parts formed by bending the tube material and an extra section for absorbing deformation, which is produced when the tube is formed, as much as possible.

The invention described in claim 3 is the tube for a heat exchanger according to claim 2, wherein the extra section has a shape to cut into the first flat section.

The invention described in claim 4 is the tube for a heat exchanger according to claim 2 or 3, wherein the extra section has a shape to cut into the second flat section.

The tube used for a heat exchanger of the present invention is provided with the partition in the passage of the tube for the heat exchanger even when it is formed of a thin material for use in a compact heat exchanger, so that a required pressure strength can be assured.

And, the partition of the tube for a heat exchanger absorbs unevenness, which is produced while machining, by the extra section as much as possible. As a result, the formed tube for the heat exchanger is prevented from having a defective brazing and can hold the required pressure strength. The tube for the heat exchanger has the passages equally divided by the partition and can prevent a defective passage or the like in the tube. Therefore, it becomes possible to produce a quality heat exchanger.

And, when the extra section is formed in such a way to cut into the first flat section, the contacted portion of the partition parts and the first flat section becomes wide, the brazing property is improved, and the partition parts and the first flat section are joined with good watertightness.

When the extra section is formed so to cut into the second flat section, the partition parts and the second flat section are joined with good watertightness.

The invention described in claim 5 is the tube for a heat exchanger according to claim 2, wherein the tube material has a size exceeding two times a vertical size of the partition in addition to a predetermined material size for forming the tube for a heat exchanger; and the partition has partition parts which are formed to protrude from the second flat section by bending and joining the ends of the tube material to form overlaid portions and bending a predetermined point of the overlaid portions at about right angles and extra sections which are joined along the second flat section.

When the extra section to be joined along the second flat section is provided according to the present invention, the tube can keep the precision of the tube shape because a deformation caused when the tube is being produced can be absorbed as much as possible by the extra section by the effect of sizing performed after or in the process of forming the tube.

The tube of the present invention has an improved pressure strength by forming the overlaid portion which has the ends of the tube material bent and joined, forming the partition parts by bending the overlaid portion, and mutually contacting the partition parts to form the partition. Therefore, the partition has a state that the tube material is overlaid four times.

The invention described in claim 6 is a method of producing a tube for a heat exchanger which is formed by rolling a flat tube material and provided with a partition for dividing a passage, wherein the tube material has a size exceeding two times a vertical size of the partition in addition to a predetermined material size for forming the tube; the method comprising a first step to form an overlaid portion by bending a predetermined portion of the ends of the tube material to substantially 180 degrees and joining; a second step to form partition parts by bending a predetermined portion of the overlaid portion or a predetermined portion of the tube material to substantially 90 degrees and extra sections for absorbing deformation, which is caused when the tube is formed, as much as possible; and a third step to form the tube by contacting the protruded ends of the partition parts to the first flat section.

The invention described in claim 7 forms the extra sections which cut into the first flat section in the first or second step of claim 6.

According to the method of producing the tube for a heat exchanger of the present invention, the contact portion between the partition parts and the first flat section becomes wide when the tube is formed because the extra section which cuts into the first flat section is formed, the brazing property is improved, and the partition parts and the first flat section are joined with good watertightness to form the tube.

The invention described in claim 8 forms the extra sections which cut into the second flat section in the first or second step of claim 6 or 7.

According to the method of producing the tube for a heat exchanger of the present invention, the partition parts and the second flat section do not cause a gap and joined with good watertightness when the tube is formed because the extra section which cuts into the second flat section is formed.

The invention described in claim 9 is the invention according to claim 6, wherein the first step includes a step to form the first bending section which becomes a bending fulcrum of the overlaid portion, and a step to form the second bending section which has an inner angle larger than that of the first bending section.

The method of producing the tube for a heat exchanger of the present invention decreases the load applied to the first bending section and forms the overlaid section while keeping precision without causing displacement on the first bending section when the second bending section which has the inner angle larger than the inner angle of the first bending section is formed at the leading end of the first bending section which is the bending fulcrum and the overlaid portion which has the ends of the tube material bent and joined is formed.

The invention described in claim 10 is the invention according to any one of claims 6 to 9, wherein the third step is provided with a step to correct unevenness in precision when the tube is formed by deforming unevenness.

According to the method of producing the tube for a heat exchanger of the present invention, unevenness in precision caused when the tube is formed is absorbed for correction by the extra section or the like, and a quality product with precision can be formed.

BRIEF DESCRIPTION OF THE DRAWINGS

FIG. 17 is an explanatory diagram schematically showing a process to form a tube for a heat exchanger by roll molding of a flat tube material.

BEST MODE FOR CARRYING OUT THE PRESENT INVENTION

Embodiments of the present invention will be described with reference to the accompanying drawings.

Figure 1:
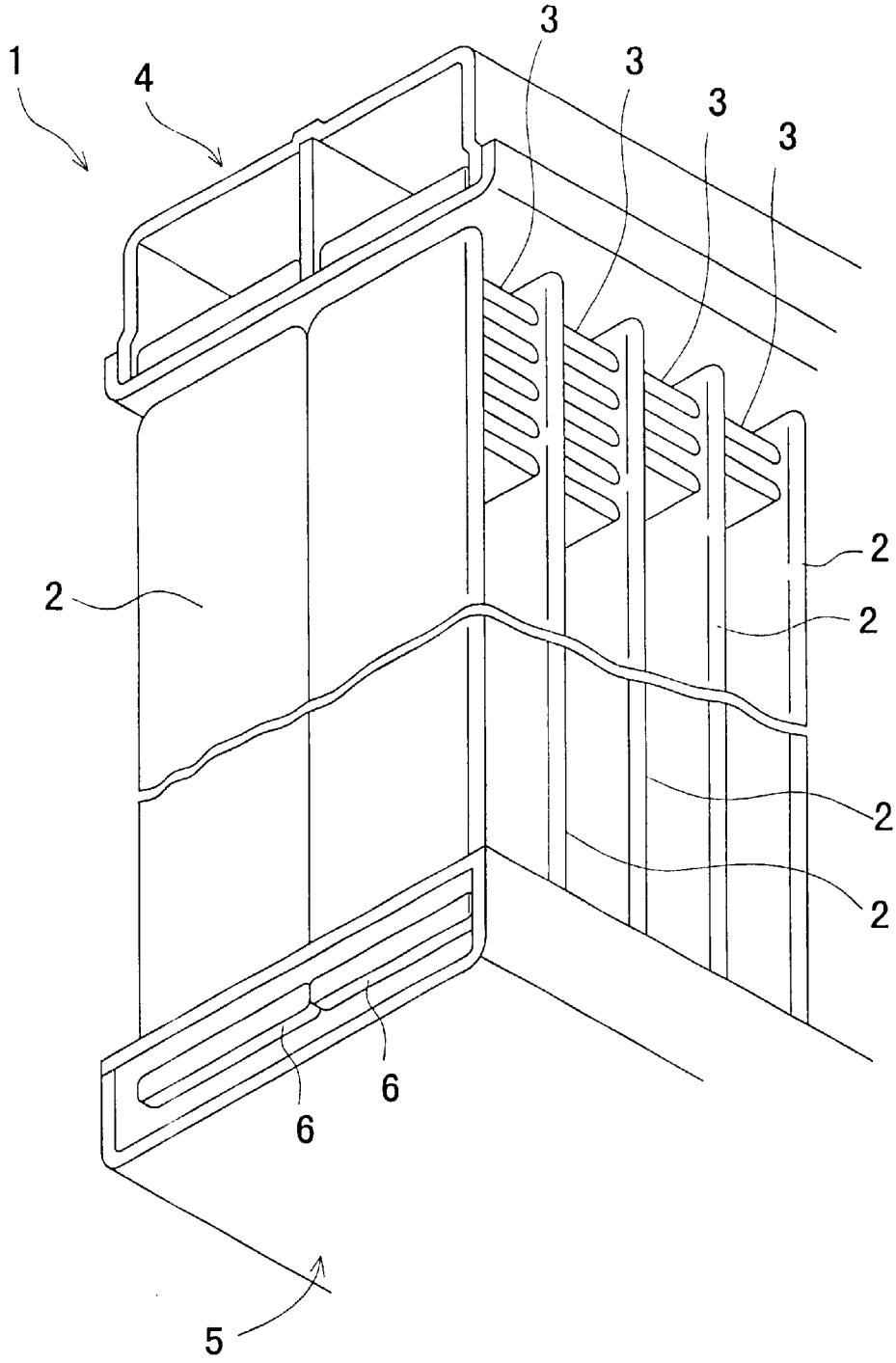
FIG. 1 is a perspective view showing a heat exchanger partly broken away according to an embodiment of the present invention.

FIG. 1 shows an example of a heat exchanger 1. For example, the heat exchanger 1 is used as a heater core or a radiator of an air conditioning system for vehicles.

The heat exchanger 1 is formed by alternately stacking flat tubes 2 and corrugated fins 3 into plural layers and bonding both ends of the stacked tubes 2 in the longitudinal direction to tanks 4, 5.

Figure 2:
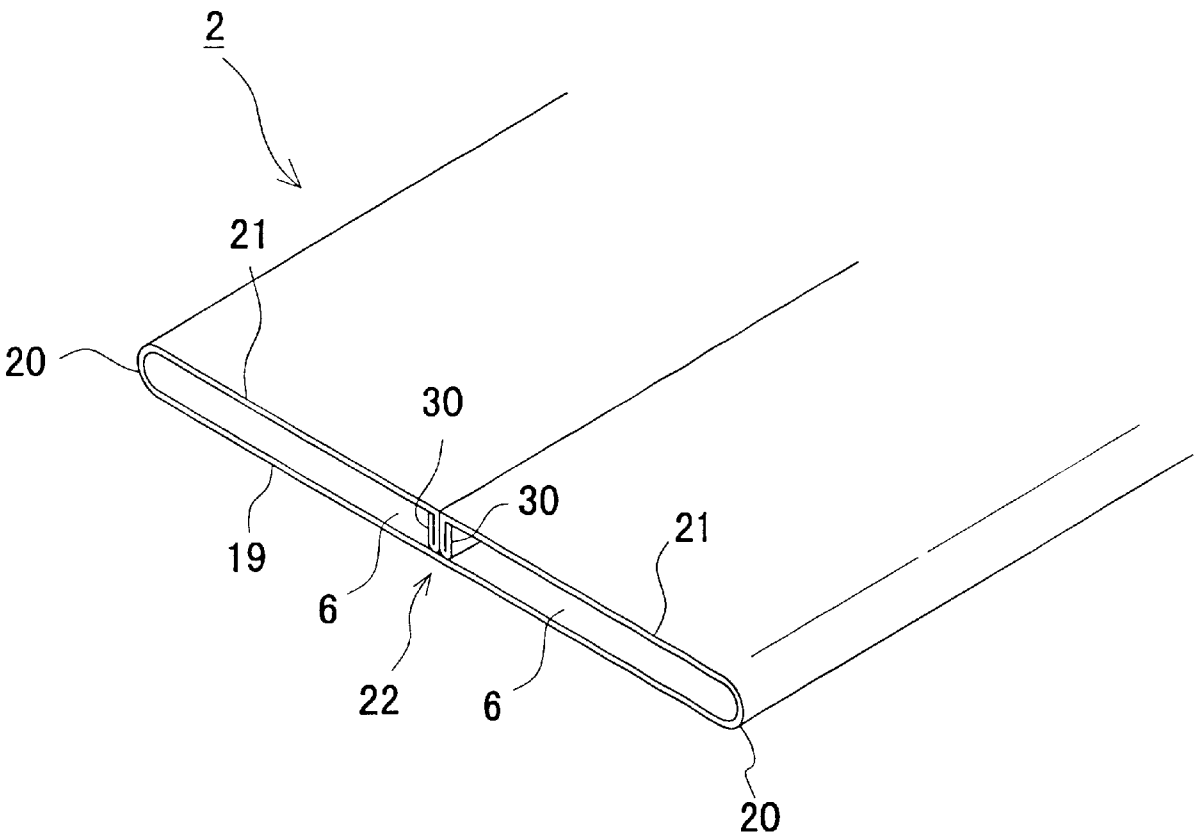
FIG. 2 is an enlarged diagram showing a connected portion of the tubes and the tanks shown in FIG. 1 according to the embodiment of the invention.

For example, the tubes 2 are formed of an aluminum material, such as an aluminum alloy, having aluminum clad with a brazing material as a main material. The tubes 2 are provided with passages 6, 6 through which a heat-exchange medium flows as shown in FIG. 1 and FIG. 2. The passages 6, 6 have an opening at either end in the longitudinal direction.

The tank 4 is provided with a supply pipe for supplying the medium to the tank 4, and the other tank 5 is provided with a discharge pipe for discharging the medium from the tank 5 (not shown).

The medium flows into the heat exchanger 1 through the supply pipe is heat-exchanged with the outside air by a heat-exchange function of the tubes 2 and fins 3 for a heat exchanger. After the heat exchange, the medium, which is condensed by the heat exchanger 1 when the heat exchanger 1 is a condenser, is discharged through the discharge pipe and circulated through a heat exchange cycle.

As shown in FIG. 2, the tube 2 is configured by a first flat section 19 which is substantially flat, first erected sections 20, 20 which are continuous from both ends of the first flat section 19 and have a nearly semicircular shape, second flat sections 21, 21 which are continuous from the first erected sections, substantially parallel to the first flat section 19 and have a size nearly half of the first flat section, and the passages 6, 6 which are divided by a partition 22 formed by contacting partition parts 30, 30.

Figure 3:
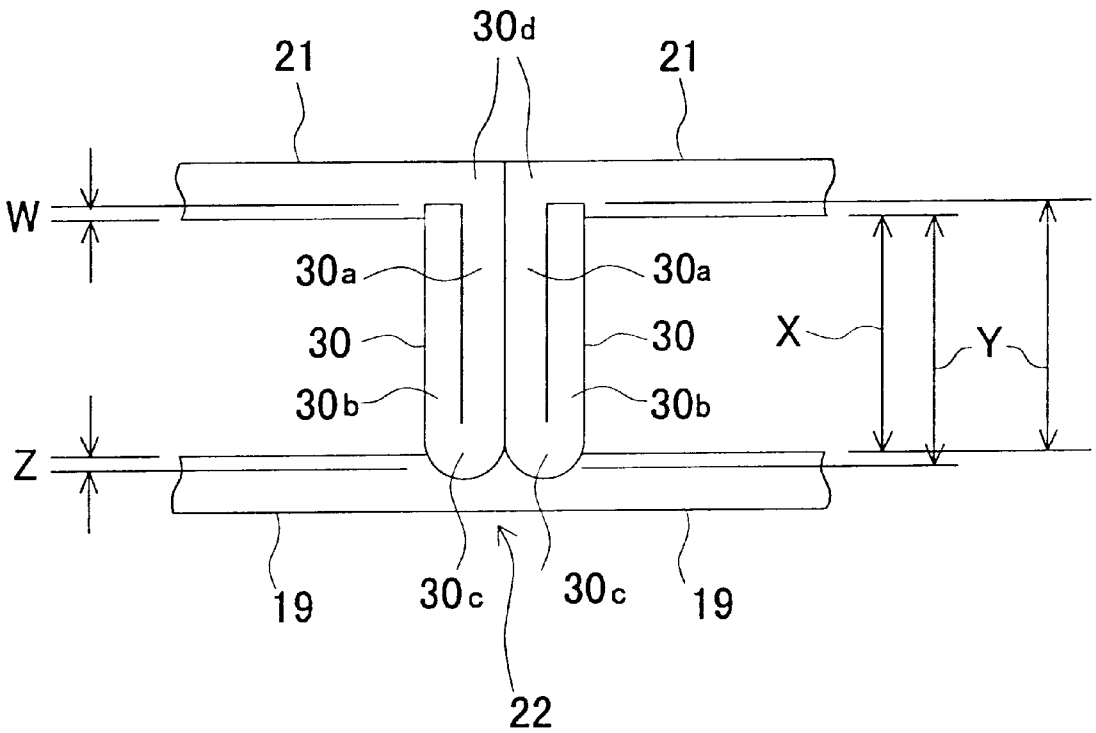
FIG. 3 is an enlarged diagram showing the vicinity of a partition of a tube for a heat exchanger according to the embodiment of the invention.

The partition part 30 is formed by bending ends of a flat tube material. As shown in FIG. 3, the partition part 30 is formed by forming a first bending section 30*c* with a predetermined point of the end of the tube material used as a fulcrum and forming a second bending section 30*d* by bending at about right angles along the edge of the tube material.

Here, the partition part 30 is to have a portion 30*a* which extends in a direction of the first flat section and a portion 30*b* which extends in a direction of the second flat section. The portion 30*a* extending in the direction of the first flat section and the portion 30*b* extending in the direction of the second flat section are not necessarily formed to have the same dimension as a length between the first and second flat sections.

For example, when an extra section which has a size (Y) slightly longer than a length (X) between the first and second flat sections is formed at the portion 30*a* extending in the direction of the first flat section, it becomes possible to make the first bending section 30*c* to cut into the first flat section 19 by a predetermined value Z (e.g., about 0.05 mm). Therefore, the partition part 30 improves a brazing property by expanding a portion to be contacted with the first flat section 19 and can be joined to the first flat section 19 with good watertightness.

For example, when an extra section which has a size (Y) slightly longer than a length (X) between the first and second flat sections is provided at the portion 30*b* extending in the direction of the second flat section, it becomes possible to make the edge of the tube material to cut into the second flat section 21 by a predetermined value W (e.g., about 0.05 mm). Therefore, the partition part 30 can be joined with the second flat section 21 with good watertightness without forming a gap.

Thus, the partition part 30 can absorb unevenness in the length of the partition part 30 as much as possible by virtue of the extra section which is formed at the portion 30*a* extending in the direction of the first flat section and the portion 30*b* extending in the direction of the second flat section. Therefore, the tube 2 does not cause a gap and improves the brazing property. Since no gap or the like is formed at the partition 22, a defective bypass or an external leakage is not caused.

Figure 4:
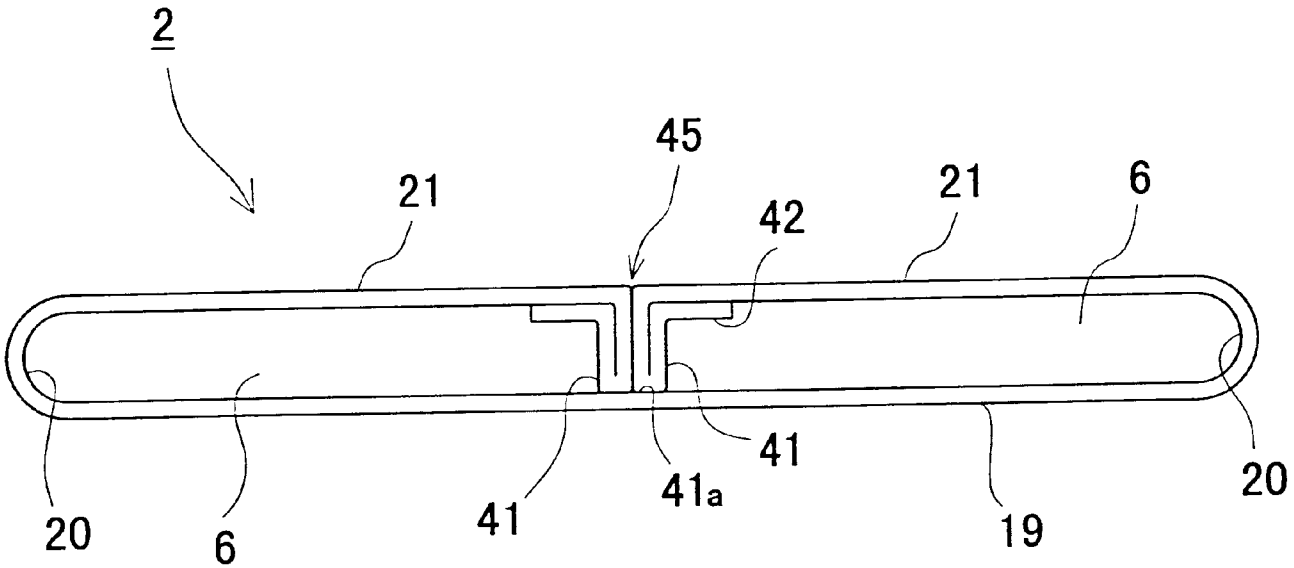
FIG. 4 is a diagram showing an end surface of a tube for a heat exchanger according to another embodiment of the invention.

Then, another embodiment of the tube 2 will be described. FIG. 4 is a diagram showing an end surface of the tube 2.

As shown in FIG. 4, the tube 2 has a partition 45 which divides the passages 6, 6 at about the center of the tube 2.

A tube material 10 is bent and joined at about 180 degrees using a predetermined point of its end as a fulcrum to form an overlaid portion and a predetermined point of the overlaid portion is bent at about 90 degrees to form a partition part 41 and an extra section 42. And, the tube 2 is configured to have the partition 45 which has both of the partition parts 41, 41 formed at both ends of the tube material 10 mutually contacted and a protruded end 41*a* of the partition part 41 contacted to the first flat section 19.

Then, a method of producing the tube 2 shown in FIG. 4 will be described.

FIG. 5 to FIG. 17 are diagrams showing an end surface of the tube material or its part in respective steps to form the tube 2 shown in FIG. 4.

Figure 5:
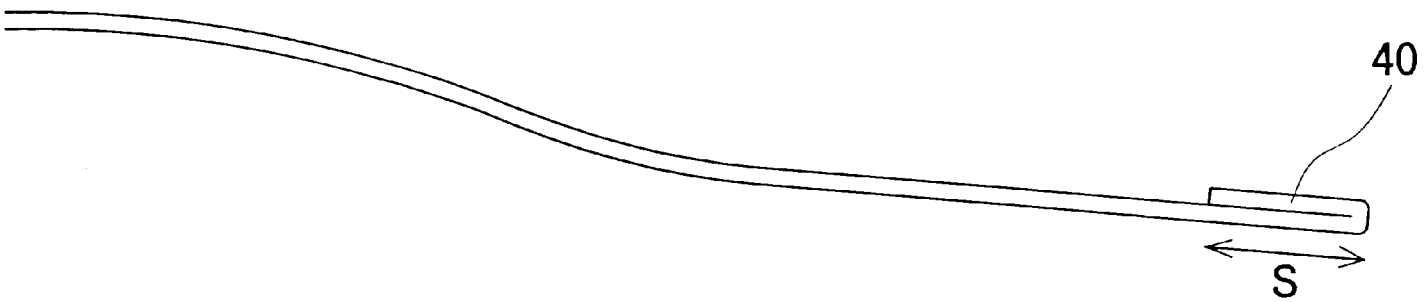
FIG. 5 is a diagram showing a state that an overlaid portion is formed at an end of a tube material.

First, a first step to form an overlaid portion 40 will be described. FIG. 5 is a diagram showing a state that the overlaid portion 40 is formed at an end of the tube material 10.

The tube material 10 has a size of more than two times a size of the partition 45 in addition to a predetermined material size for forming the tube 2.

First, the tube material 10 is formed a first bending section 43 at its both ends. The first bending section 43 is formed by bending the tube material 10 using as a fulcrum a portion which can form the overlaid portion 40 having a size between the first and second flat sections 19, 21, namely a size (S) exceeding a size (X) of the partition 45 (see FIG. 3).

Figure 6:
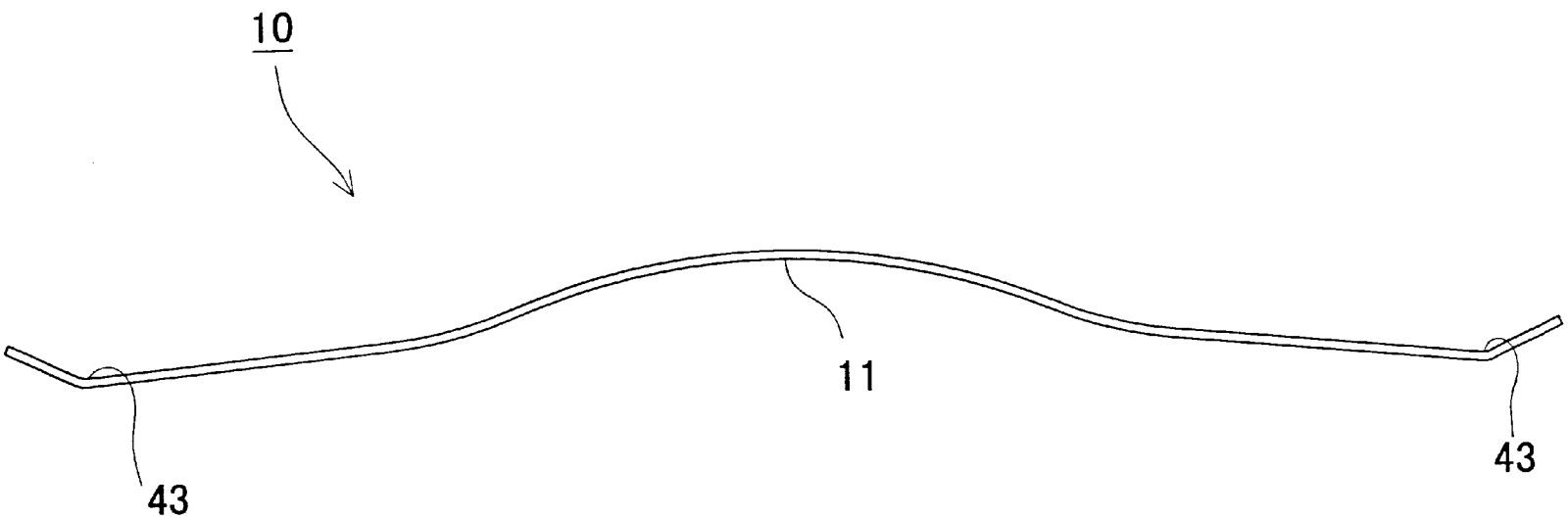
FIG. 6 is an explanatory diagram schematically showing a process of bending a first bending section, which is formed at either end of a tube material, at an inner angle of 120 degrees according to the embodiment of the invention.
Figure 7:
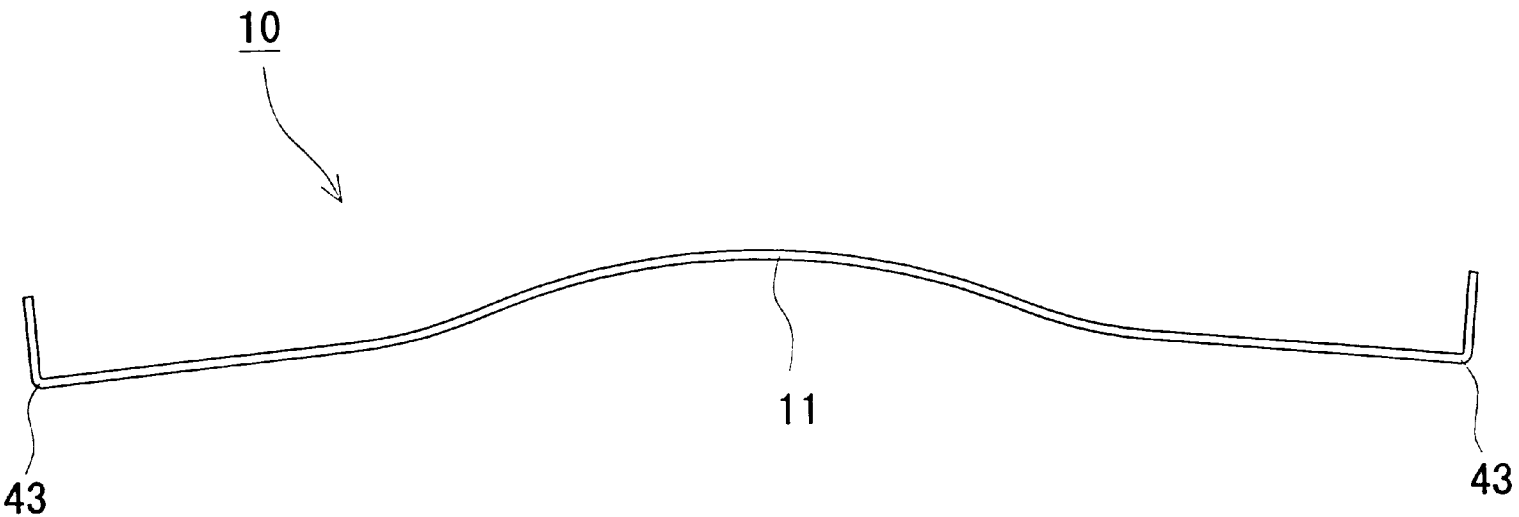
FIG. 7 is an explanatory diagram schematically showing a process of bending the first bending section, which is formed at either end of the tube material, at an inner angle of 90 degrees.
Figure 8:
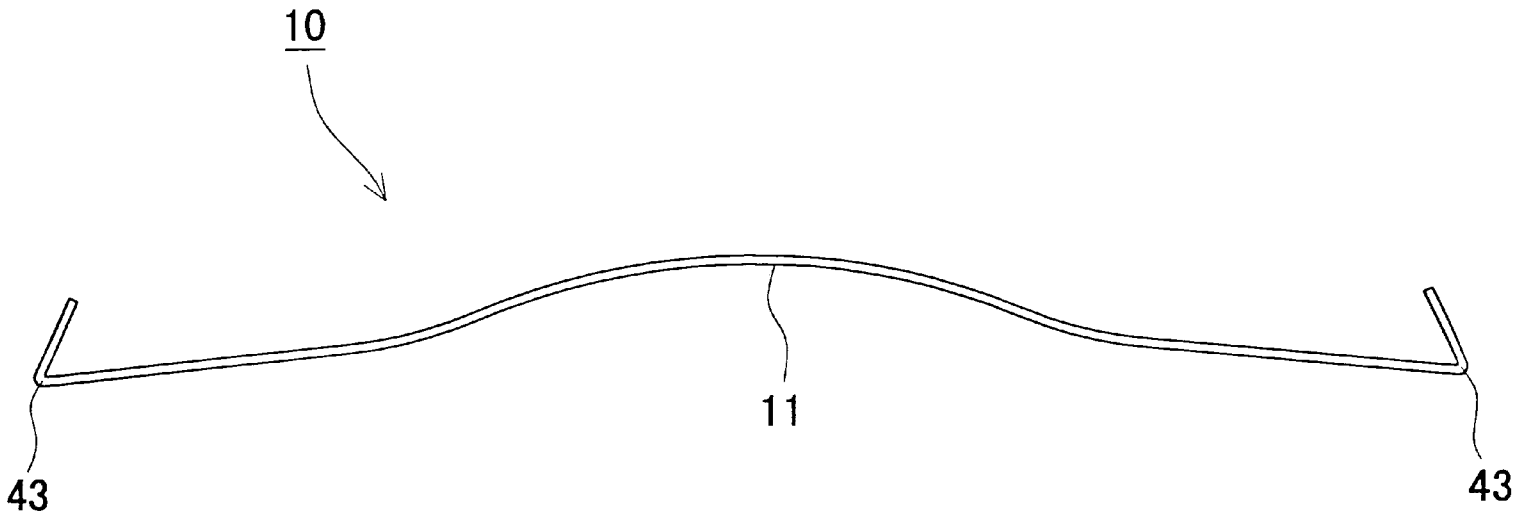
FIG. 8 is an explanatory diagram schematically showing a process of bending the first bending section, which is formed at either end of the tube material, at an inner angle of about 40 to 80 degrees.

The first bending section 43 is formed by bending in such a way that a first bending angle has an inner angle of about 120 degrees, bending in such a way that a second bending angle has an inside angle of about 90 degrees, and gradually bending in such a way that a third bending angle has an inside angle of about 40 to 80 degrees as shown in FIG. 6 to FIG. 8.

Thus, when the first bending section 43 is formed by gradually bending, unevenness which is produced when bending is reduced, and a load on the bending fulcrum of the first bending section 43 is decreased. Therefore, the heat-exchanger tube formed can maintain accuracy by the dimensional control.

The bending angle to form the first bending section 43 is not limited to the aforementioned angle but can include a first bending angle of 90 degrees or more, a second bending angle of 90 degrees or less and a third bending angle which is not larger than the second bending angle.

A curved portion 11 is formed at about the center of the tube material 10 to protrude in a direction of forming the first bending section in order to maintain accuracy of the tube 2 by absorbing deformation caused when the tube is formed, to be described later, by the curved portion 11.

Figure 9:
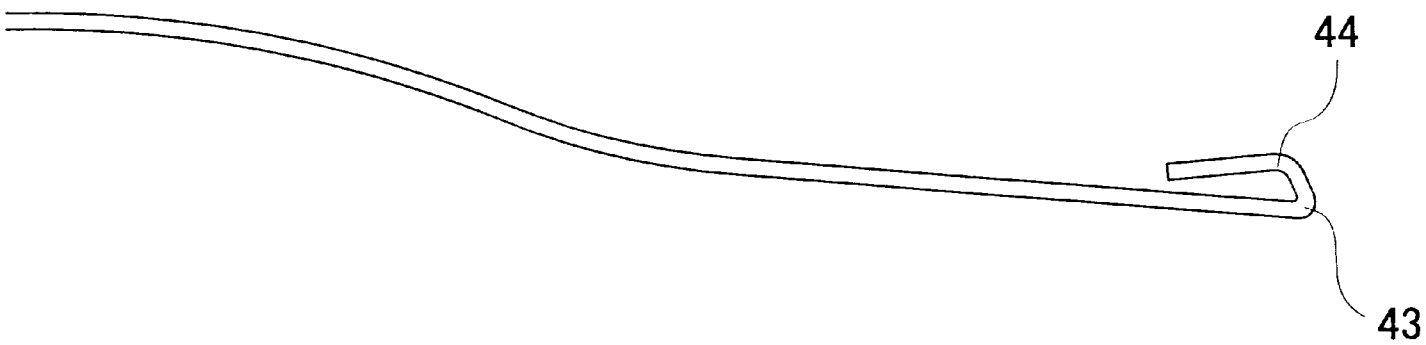
FIG. 9 is an explanatory diagram schematically showing a process of forming a second bending section at the leading end of the first bending section to be formed at the ends of the tube material.
Figure 10:
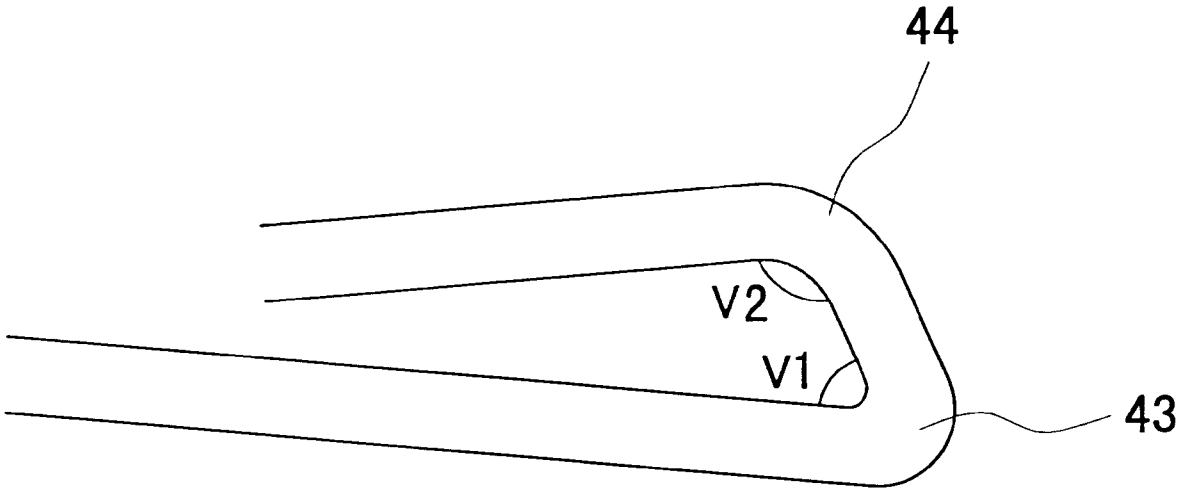
FIG. 10 is an enlarged diagram showing the first and second bending sections shown in FIG. 9.

Then, a second bending section 44 which has an inner angle larger than that of the first bending section 43 is formed at the leading end of the first bending section 43 as shown in FIG. 9 and FIG. 10. It is assumed that the second bending section 44 has an inner angle of 110 degrees, for example.

Specifically, it is assumed that the inner angle of the first bending section 43 is V1 and the inner angle of the second bending section 44 is V2, and the second bending section 44 is formed to have V1<V2.

The second bending section 44 is formed to avoid a problem that a fulcrum is displaced and the bending section 43 has unevenness when the overlaid portion 40 is formed by bending the end of the tube material at a single stroke.

Differences between the formation of the second bending section 44 and no formation of it will be described in the form of vectors.

Figure 11:
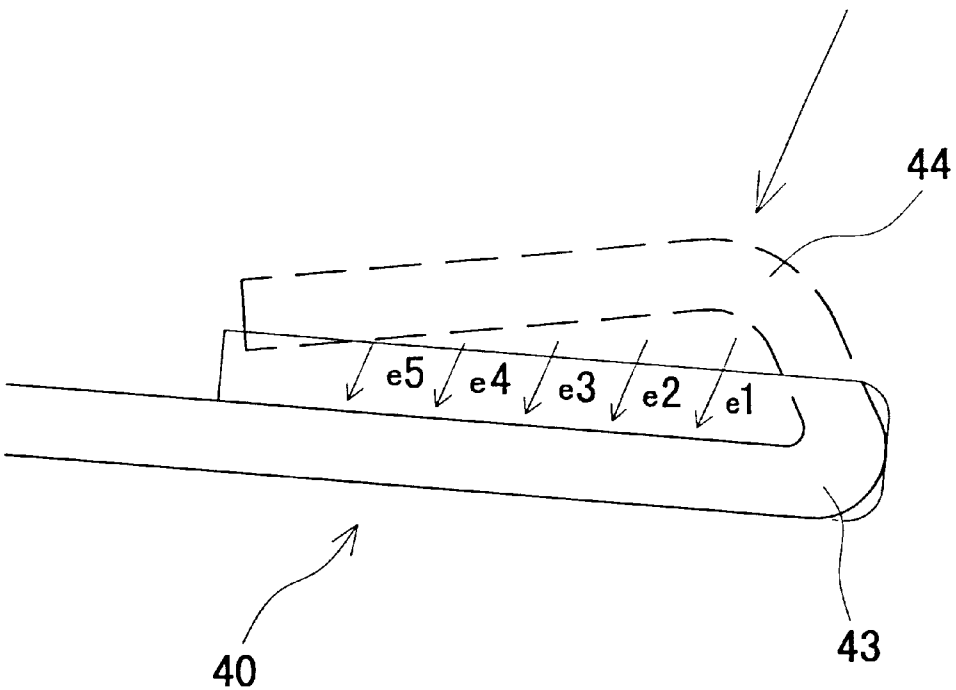
FIG. 11 is an explanatory diagram showing vectors of a load applied to the first bending section when an overlaid portion is formed by forming the second bending section and bending it at about 180 degrees with the first bending section as a fulcrum.
Figure 12:
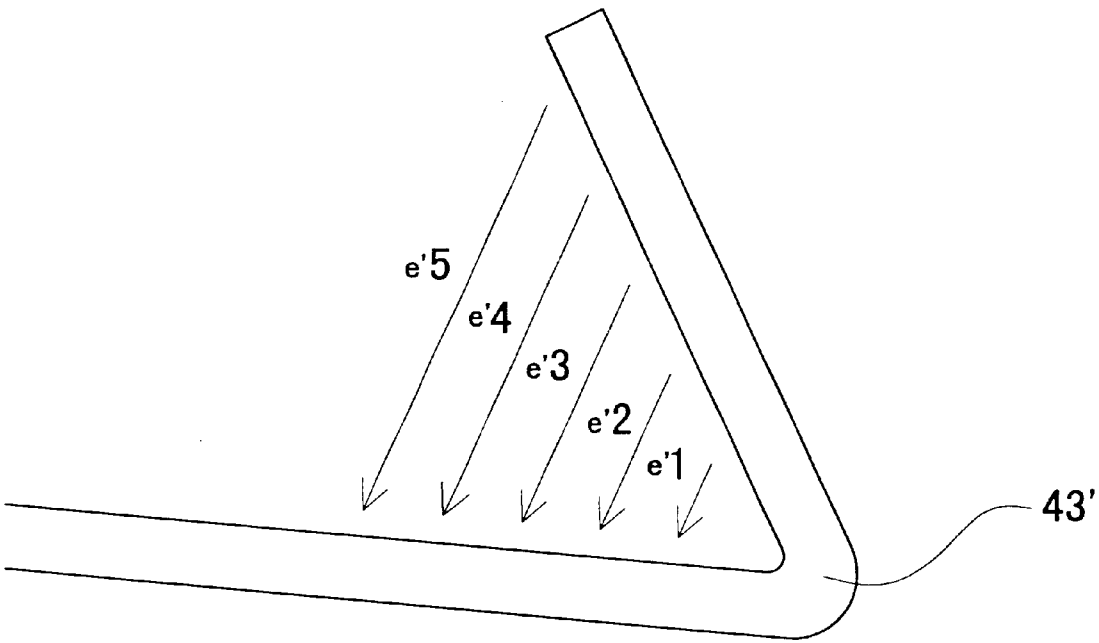
FIG. 12 is an explanatory diagram showing vectors of a load applied to the first bending section when an overlaid portion is formed by bending at about 180 degrees with the first bending section as a fulcrum without forming the second bending section.

FIG. 11 shows a load on the first bending section 43 when the second bending section 44 is formed, as a vector sum E=e1+e2+e3+e4+e5. Meanwhile, FIG. 12 shows a load on a first bending section 43' when the second bending section 44 is not formed, as a vector sum E'=e'1+e'2+e'3+e'4+e'5. When these two vector sums E, E' are compared, it is obvious that they have a relation of E<E'.

Therefore, when the second bending section 44 is formed, the load applied to the bending section 43 becomes small and unevenness produced by the load is decreased, thereby keeping accuracy of the overlaid portion 40.

And, the second bending section 44 is pressed down and joined to form the overlaid portion 40.

Figure 13:
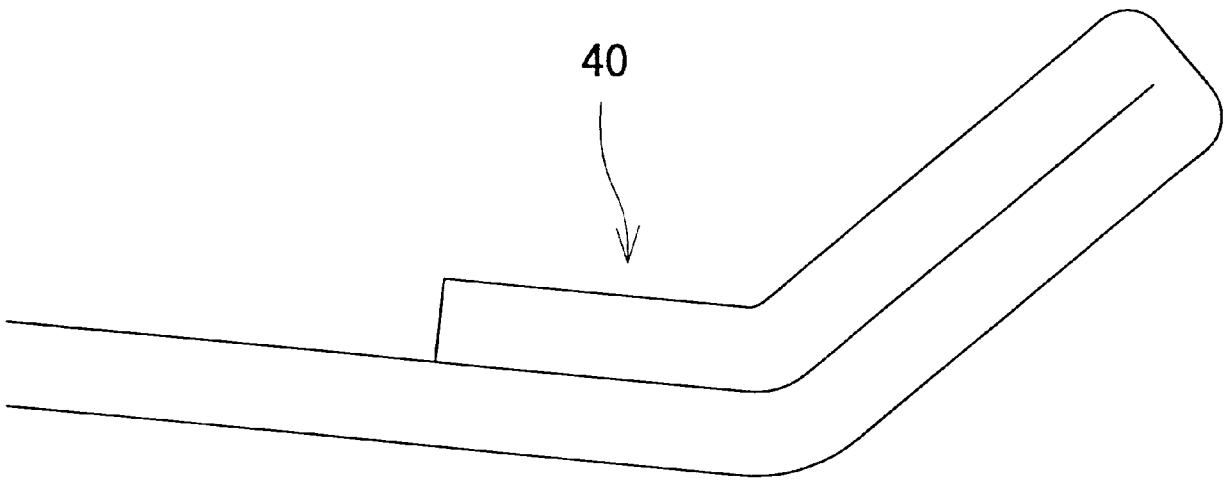
FIG. 13 is an enlarged diagram of an end portion of a tube material, showing an explanatory diagram schematically showing a process to form a partition part and an extra section by bending the overlaid portion.
Figure 14:
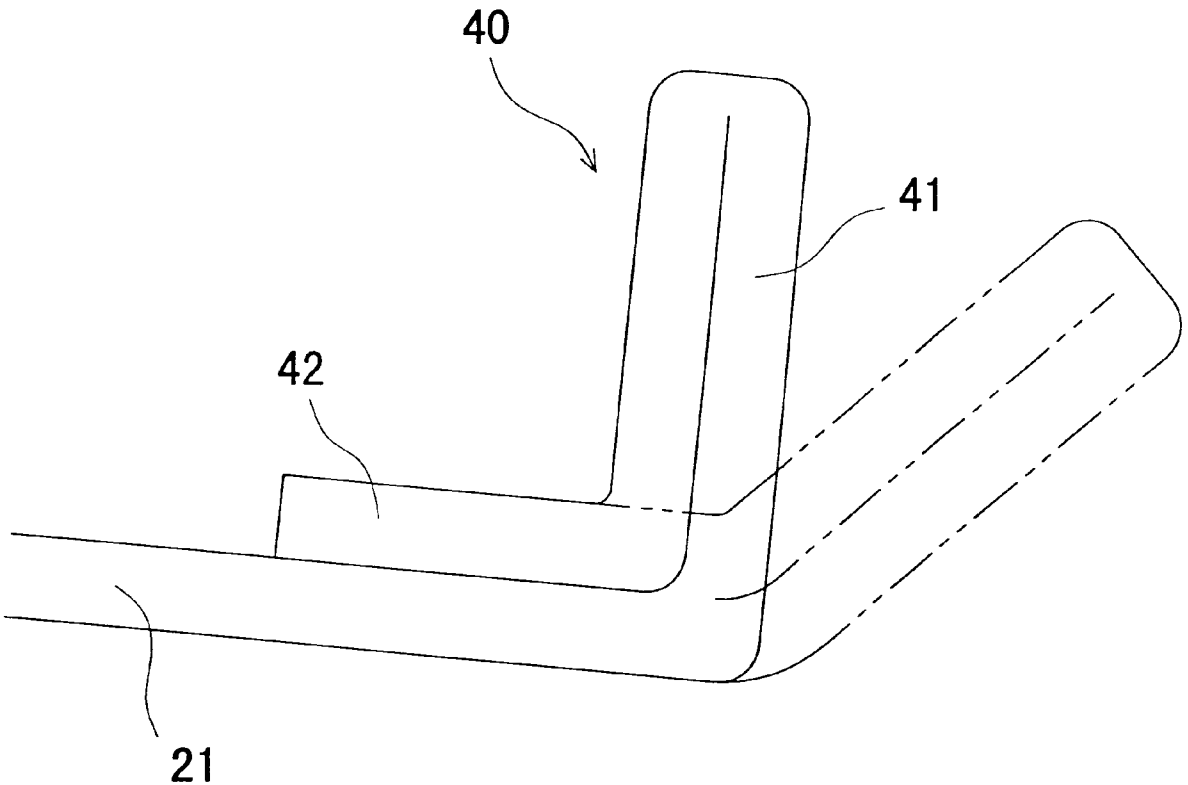
FIG. 14 is an enlarged diagram of the end portion of the tube material, showing an explanatory diagram schematically showing a process to form the partition part and the extra section by bending the overlaid portion.

Then, a second step to form the partition part 41 and the extra section 42 will be described. FIG. 13 and FIG. 14 are explanatory diagrams schematically showing steps to form the partition part 41 and the extra section 42 from the overlaid portion 40.

The partition part 41 is formed by determining as a bending fulcrum a portion which satisfies a size between the first flat section 19 and the second flat section 21 of the overlaid portion 40, namely a portion satisfying the partition 45, and bending at about right angles with the bending fulcrum at the center. The partition part 41 is a portion protruded from the portion configuring the second flat section 21, and the extra section 42 is a portion which is joined along the portion configuring the second flat section 21.

First, the overlaid portion 40 is bent at an inner angle of about 120 degrees with the fulcrum at the center as shown in FIG. 13. Then, the overlaid portion 40 is bent at an inner angle of about 90 degrees with the fulcrum at the center to form the partition part 41 and the extra section 42 as shown in FIG. 14. Then, sizing is performed to adjust deviations in the size caused when the partition part 41 and the extra section 42 are formed.

Figure 15:
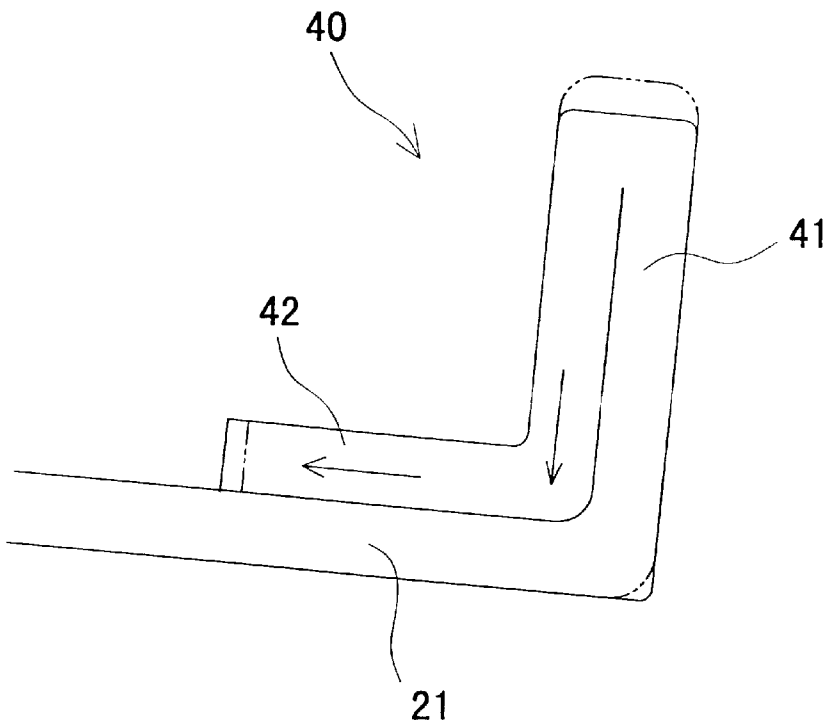
FIG. 15 is an enlarged diagram of the end portion of the tube material, showing a process to size after the partition part and the extra section are formed.

FIG. 15 is a diagram showing a sized state. The arrows in FIG. 15 indicate a loading direction that a force is applied by sizing. The broken lines in FIG. 15 indicate the shapes of the partition part 41 and the extra section 42 before sizing.

The force applied by sizing hits against the portion forming the second flat section 21 and then applied in the direction of the extra section 42 joined along the second flat section 21. Therefore, the extra section 42 is deformed, and the size of the partition part 41 is accurately controlled.

Figure 16:
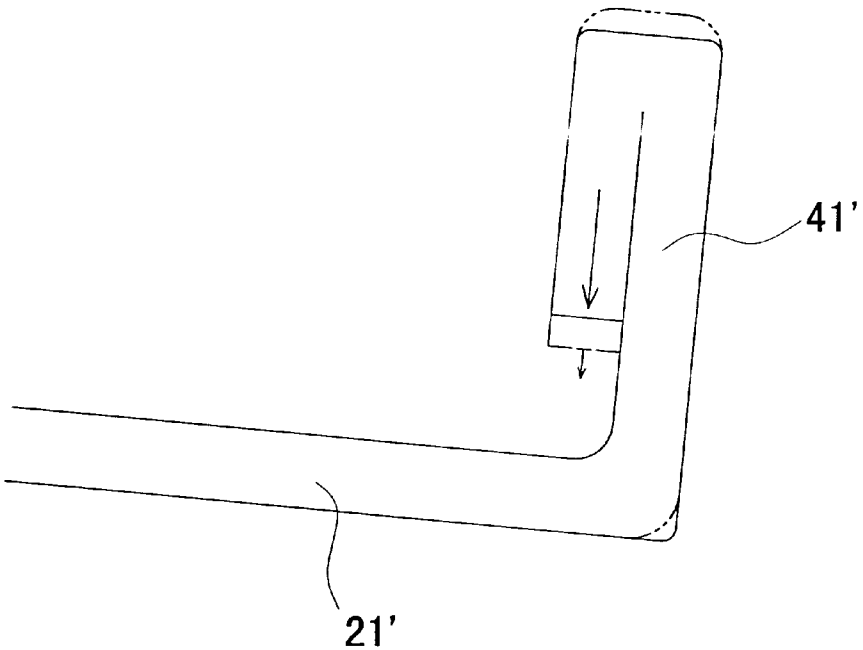
FIG. 16 is a diagram showing a process to size after the partition part is formed when the extra portion is not formed.

Meanwhile, FIG. 16 is a diagram showing that a gap is formed at a portion where a partition part 41' and a second flat section 21' are formed because the extra section 42 is not formed. As shown in FIG. 16, when the gap is formed between the partition part 41' and the portion where the second flat section 21' is formed, accurate dimensional control cannot be made even if the dimensional control is made by sizing because the force, which was applied when sizing, is relieved from the leading end of the partition part 41'.

Since the partition 45 of the tube 2 in this embodiment has the extra section 42 joined along the second flat section 21, a sizing effect is fully produced, and accurate dimensional control can be made.

Therefore, when the partition 45 is formed by contacting both of the partition parts 41, the passages 6, 6 of the heat-exchanger tube can be divided equally by the partition 45, a defective flow in the tube is not caused, and manufacturing of quality products becomes possible.

Lastly, a third step to form the tube 2 will be described. FIG. 17 is an explanatory diagram schematically showing respective steps to form the tube 2 from the tube material 10 having the partition part 41.

First, predetermined portions where the first erected portions 20, 20 of the tube material 10 are formed are bent in order of (a), (b), (c) and (d) at about right angles in an upward direction in the drawing. When the tube material 10 becomes about right angles, the tube material 10 curved in the lower direction is restored to the original state as indicated by an arrow (f). And, from the state that the tube material 10 has nearly right angles, a protruded section 41*a* of the partition part 41 is bent so to come into contact with about the center of the tube material 10. Two passages 6, 6 are formed through the above steps, and the tube 2 is completed.

The tube 2 formed through the above first to third steps and the fin 3 are alternately stacked, the open ends of the tube 2 are inserted into the tube insertion holes of the tanks 4, 5 to temporarily assemble the heat exchanger, and the temporarily assembled heat exchanger is brazed in an oven. Thus, the tubes 2 and the tanks 4, 5 and also the tubes 2 and the fins 3 are brazed to complete the heat exchanger 1.

According to the heat exchanger, the tube for the heat exchanger and its production method of this embodiment, a good product can be produced without causing a defective brazing of the partition parts, defective strength or defective flow in the tube.

The partitions 22, 45 of the tube 2 for a heat exchanger according to this embodiment are formed by folding the tube material four times, so that brazing is improved, and a pressure strength is also improved.

Industrial Applicability

The heat exchanger, the tube for the heat exchanger and its production method according to the invention are to remove unevenness caused in producing the tube as much as possible, and particularly suitable for a compact heat exchanger or a tube used for the compact heat exchanger.

What is claimed is:

1. A tube for a heat exchanger which is formed by rolling a flat tube material and has a passage with at least one end open, wherein:

the tube is provided with a first flat section, first erected sections which are erected at about right angles from both ends of the first flat section, a second flat section which is continuous from the first erected sections and substantially parallel to the first flat section, and a partition for dividing a tube passage;

the partition is provided with overlaid portion which are formed by bending and joining the ends of the tube material;

the overlaid portion provided at one end of the tube material and the overlaid portion provided at the other end of the tube material are joined to form a partition part;

the partition part includes extra sections at both ends of each overlaid portion; and the extra sections are joined with the first and second flat sections.

2. A tube for a heat exchanger which is formed by rolling a flat tube material and has a passage with at least one end open, wherein:

the tube is provided with a first flat section, first erected sections which are erected at about right angles from both ends of the first flat section, a second flat section which is continuous from the first erected sections and substantially parallel to the first flat section, and a partition for dividing a tube passage;

the partition is provided with overlaid portion which are formed by bending and joining the ends of the tube material;

the partition has a partition part formed by bending a predetermined point of the overlaid portions at about right angles to protrude from the second flat section, and extra sections joined along the second flat section; and the tube material has a size exceeding two times a vertical size of the partition in addition to a predetermined material size for forming the tube for a heat exchanger.

3. A method of producing a tube for a heat exchanger which is formed by rolling a flat tube material and provided with a partition for dividing a passage, wherein the tube material has a size exceeding two times a vertical size of the partition in addition to a predetermined material size for forming the tube; the method comprising:

a first step to form an overlaid portion by bending a predetermined portion of the ends of the tube material and joining them;

a second step to form a partition part by bending a predetermined portion of the overlaid portion or a predetermined portion of the tube material to about 90 degrees, and an extra section for absorbing deformation which is caused during formation of the tube as much as possible; and a third step to form the tube by contacting a protruded end of the partition part; and wherein in the first or second step, an extra section which cuts into the first flat section or the second flat section is formed.

4. The method of producing a tube for a heat exchanger according to claim 3 wherein the first step includes a step to form a first bending section which becomes a bending fulcrum of the overlaid portion, and a step to form a second bending section which has an inner angle larger than that of the first bending section.

* * * * *